US007565762B2

(12) United States Patent
Lackey

(10) Patent No.: US 7,565,762 B2
(45) **Date of Patent: *Jul. 28, 2009**

(54) APPARATUS AND METHOD FOR SUPPORTING A FIREARM

(76) Inventor: George C. Lackey, 331 E. Broadway, Centralia, IL (US) 62801

( * ) Notice: Subject to any disclaimer, the term of this patent is extended or adjusted under 35 U.S.C. 154(b) by 0 days.

This patent is subject to a terminal disclaimer.

(21) Appl. No.: 11/848,006

(22) Filed: Aug. 30, 2007

(65) Prior Publication Data

US 2008/0172919 A1 Jul. 24, 2008

(51) Int. Cl.
*F41A 9/62* (2006.01)

(52) U.S. Cl. ..... 42/94; 211/64; 248/694

(58) Field of Classification Search ..... 42/94; 89/37.04; 248/218.4, 219.4, 227.3, 230.2, 248/230.3, 694; 211/64
See application file for complete search history.

(56) References Cited

U.S. PATENT DOCUMENTS

| | | | | |
|---|---|---|---|---|
| 1,090,929 | A | 3/1914 | McFaddin | |
| 1,337,359 | A | 4/1920 | Johnston | |
| 1,554,118 | A * | 9/1925 | Moran | 248/103 |
| 1,816,723 | A | 7/1931 | Dunoyer | |
| 1,828,106 | A | 10/1931 | Ertola | |
| 2,110,037 | A * | 3/1938 | De Rosa | 248/104 |
| 2,540,584 | A * | 2/1951 | Jaycox | 248/515 |
| 2,847,909 | A | 8/1958 | Kester | |
| 2,932,226 | A | 4/1960 | Seppola | |
| 3,225,656 | A | 12/1965 | Flaherty et al. | |
| 3,233,517 | A | 2/1966 | Morrison | |
| 3,302,497 | A | 2/1967 | Paden | |
| 3,576,084 | A | 4/1971 | Anderson, Jr. | |
| 3,584,821 | A | 6/1971 | Glebe | |
| 3,753,016 | A | 8/1973 | Ballard | |
| 3,805,646 | A | 4/1974 | Knight | |
| 4,481,964 | A | 11/1984 | Minneman | |
| 4,531,643 | A | 7/1985 | Bradley | |
| 4,844,390 | A | 7/1989 | Duke | |
| 4,913,391 | A | 4/1990 | Klipp | |
| 5,287,643 | A | 2/1994 | Arizpe-Gilmore | |
| 5,414,949 | A | 5/1995 | Peebles | |
| 5,438,786 | A | 8/1995 | Hilderbrand | |
| 5,481,817 | A | 1/1996 | Parker | |
| 5,553,717 | A | 9/1996 | Minneman et al. | |
| 5,566,915 | A | 10/1996 | Hansare | |
| 5,715,624 | A | 2/1998 | Hilbelink et al. | |
| 5,723,808 | A | 3/1998 | Devall | |
| 5,769,372 | A | 6/1998 | Klosterman | |
| 5,829,099 | A | 11/1998 | Kopelman et al. | |

(Continued)

FOREIGN PATENT DOCUMENTS

| | | | |
|---|---|---|---|
| EP | 0618045 | A1 | 10/1994 |

*Primary Examiner*—Michelle Clement
(74) *Attorney, Agent, or Firm*—H. Frederick Rusche; Husch Blackwell Sanders LLP

(57) ABSTRACT

A firearm supporting apparatus suitable for use with shafts of varying diameters and lengths includes an elongated support member having a clamping surface and a firearm supporting surface; a rigid attachment mechanism connected with the elongated support member; and an adjustable mechanism connecting the attachment mechanism with the elongated support member and adjusting the position of the collar relative to the clamping surface of the support member, the collar and clamping surface securing the support member to the shaft. In one embodiment the adjustable mechanism includes an elongated threaded member connected with the attachment mechanism and the elongated support member and a fastening device associated with the threaded member.

13 Claims, 4 Drawing Sheets

U.S. PATENT DOCUMENTS

| | | | | |
|---|---|---|---|---|
| 5,930,931 | A | 8/1999 | Watons | |
| 5,979,099 | A | 11/1999 | Kervin | |
| 6,032,911 | A * | 3/2000 | Osborne | 248/309.1 |
| 6,276,087 | B1 | 8/2001 | Singletary | |
| 6,505,429 | B2 | 1/2003 | Percival | |
| 6,526,687 | B1 | 3/2003 | Looney | |
| 6,539,660 | B1 | 4/2003 | Yeargini | |
| 6,543,175 | B1 | 4/2003 | Tucker | |
| 6,546,662 | B1 | 4/2003 | Chong | |
| 6,560,911 | B2 | 5/2003 | Sharp | |
| 6,568,116 | B2 | 5/2003 | Hathaway | |
| 6,578,309 | B1 | 6/2003 | Frisce | |
| 6,588,637 | B2 | 7/2003 | Gates et al. | |
| 6,789,450 | B1 * | 9/2004 | Helfet | 81/64 |
| 2002/0088163 | A1 | 7/2002 | Young et al. | |
| 2002/0178637 | A1 | 12/2002 | Graham | |
| 2006/0231723 | A1 * | 10/2006 | Fayerman | 248/540 |
| 2008/0116340 | A1 * | 5/2008 | Greene | 248/229.15 |

* cited by examiner

APPARATUS AND METHOD FOR SUPPORTING A FIREARM

CROSS-REFERENCE TO RELATED APPLICATIONS

This application claims the priority of application Ser. No. 10/631,230, filed Jul. 31, 2003 now U.S. Pat. No. 7,493,719.

TECHNICAL FIELD OF THE INVENTION

This invention generally relates to firearm accessories and, more particularly, to a portable gun rest.

DESCRIPTION OF THE RELATED ART

The use of supports and rests of various kinds in order to aid the accurate shooting of firearms is well known in the prior art. Gun rests have been used since the invention of firearms. Buffalo hunters in the American West are known to have used bi-pods made of crossed sticks tied together upon which to rest their rifles. It is therefore well known that the use of a supporting device or rest to give stability to a firearm can substantially improve accuracy.

One general type of firearm supports are those which are used in shooting from fixed positions and commonly referred to as a category of "bench rests". These devices are primarily used for target range shooting from a fixed position and are designed and use primarily for testing and sighting in firearms rather than for hunting. These firearm rests are simply are too large and unwieldy for field use. Examples of this type of rest are exemplified by U.S. Pat. No. 6,526,687.

Another group of devices can be generally described as bi-pods, tri-pods, and mono-pods. Some of these devices are affixed permanently to the firearm, while others are removable. These devices include a gun support mounted at the top of the mono-pod or at the junction of the two or three legs forming the bi-pod or tri-pod. The leg or legs are integral to the design of the item. A significant limitation of these designs is that the elevation of the firearm in a shooting position is dictated by the length of the integral vertical members; in other words, the vertical height of the firing position cannot exceed the vertical length of the supporting member, nor can it be lower than permitted by the length of the legs. In the case of bi-pods or tri-pods with fixed leg lengths, the lower elevation is limited by the fact that the height is lowered by extending the legs farther outward. As the legs are extended outward, they ultimately reach a point of instability which point is the limit of lower elevation.

In order to overcome the shortcoming with respect to elevation, a number of bi-pods and mono-pods have been developed that allow the elevation to be increased and decreased by means of telescoping or nesting tubes which may be extended or retraced to substantial degree. Examples of this type of rest are exemplified by U.S. Pat. Nos. 6,574,899; 6,505,429 and 3,225,656. Although these designs represent an improvement over the fixed leg devices, they still suffer from certain limitations. First, the upper elevation is still limited by the total achievable length of the vertical members. Second, the lower elevation is limited by the length of the longest telescoped section. Third, the vertical members are integral to the rest. If a vertical member is broken or damaged, the whole unit is rendered useless. Further, these units are not sufficiently strong to be used as a walking stick, which would be highly desirable.

There are a number of devices that combine the benefits of a gun rest with a walking stick. U.S. Pat. No. 5,438,786 describes a pistol rest mounted at the top of a rigid telescoping support rod. However, this device is not suitable for longer firearms. Further the extent of vertical adjustment is fixed by the total length of the telescoping parts of the rod, and the rod itself is integral to the device.

U.S. Pat. No. 4,481,964 describes a walking stick and shooting rest that includes an L-shaped cane with a rectangular cross-section and a series of serrations which is placed within a rectangular opening in a shorter, elongated member that may be moved vertically up and down the cane. A gun is rested on the shorter member and the downward weight shift causes the two members to become firmly engaged. This device suffers from two key limitations. First, the upper elevation of the elongated rest is limited by the length of the cane and the rest cannot be used without the use of the cane, which is particularly designed for it. Second, the rest is not firmly attached to the vertical member but instead is simply forced into a fixed position by the weight applied to the rest.

Another example of such a device is described in U.S. Patent Application Publication No. 2002/0178637. This device is a gun rest consisting primarily of a flat plate with a tear drop shaped hole at one end through a shaft may be inserted. A weight placed upon the plate latches it against the shaft. A firearm may be placed in an angle formed by a bend in the plate distal to the shaft. This device would accommodate a shaft of variable length and material and the shaft, size, and material would be selected by the user. However, the plate that serves as the gun rest is not firmly affixed at any time to the shaft, but, instead, depends upon the weight of the gun to lock it to the shaft. When the gun is removed, the support readily slides up and down on the shaft. In addition, although the support will accept shafts of various diameters, the smaller the diameter, the greater the downward angle of the rest, which may cause an awkward and unstable seating for the firearm.

Therefore, providing a gun rest that works with various shafts, including walking sticks, still provides a stable support, and may be removably fixed in a position, would be highly desirable.

The present invention is directed to overcoming one or more of the problems set forth above.

SUMMARY OF THE INVENTION

An aspect of the present invention is to provide a pocket-sized gun rest that may be easily carried and works with shafts of varying diameters and lengths, including walking sticks.

Another aspect of the present invention is to provide a gun rest that provides a firm, stable, and at least generally horizontal support for a firearm.

Yet another aspect of the present invention is to provide a gun rest that may be positively fixed in a position yet also readily adjusted to various heights along the entire length of a shaft.

In accordance with the one or more of the above aspects of the invention, there is provided a firearm supporting apparatus suitable for use with shafts of varying diameters and lengths that includes an elongated support member having a clamping surface and a firearm supporting surface; a rigid attachment mechanism connected with the elongated support member; and an adjustable mechanism connecting the attachment mechanism with the elongated support member and adjusting the position of the attachment mechanism relative to the clamping surface of the support member, the attachment mechanism and clamping surface securing the support member to the shaft. In one embodiment the adjustable mechanism includes an elongated threaded member connected with the attachment mechanism and the elongated support member and a fastening device associated with the threaded member.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

Figure 1:
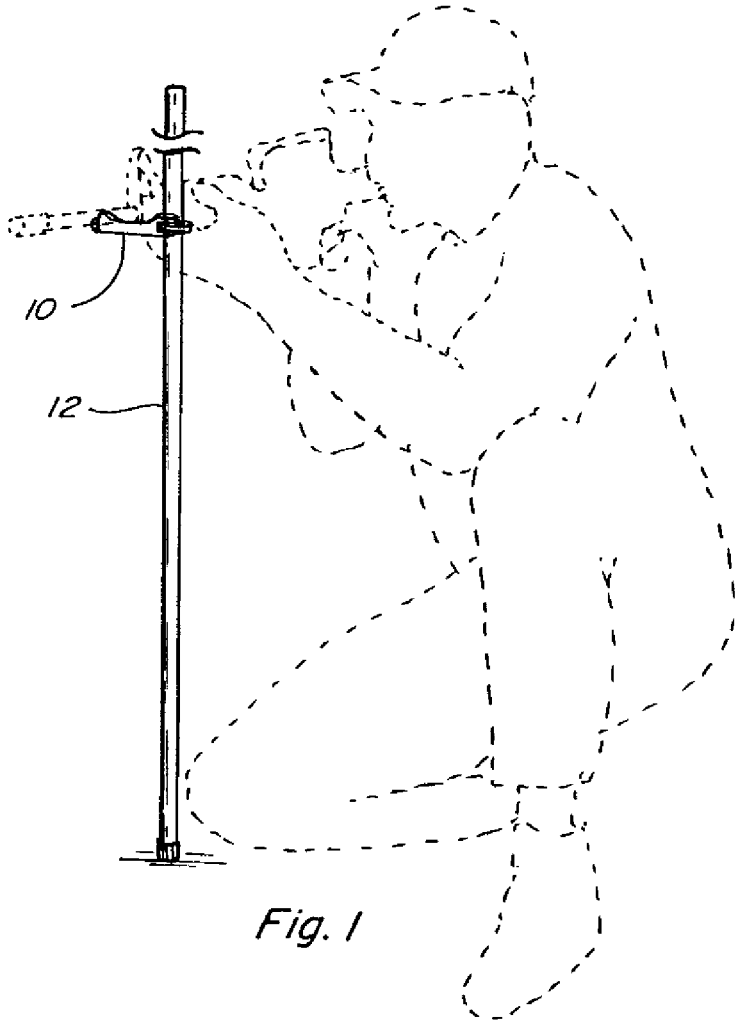
FIG. 1 is a schematic view of a firearm supporting apparatus according to one embodiment of the present invention in use on a shaft by a shooter in a kneeling position.
Figure 4:
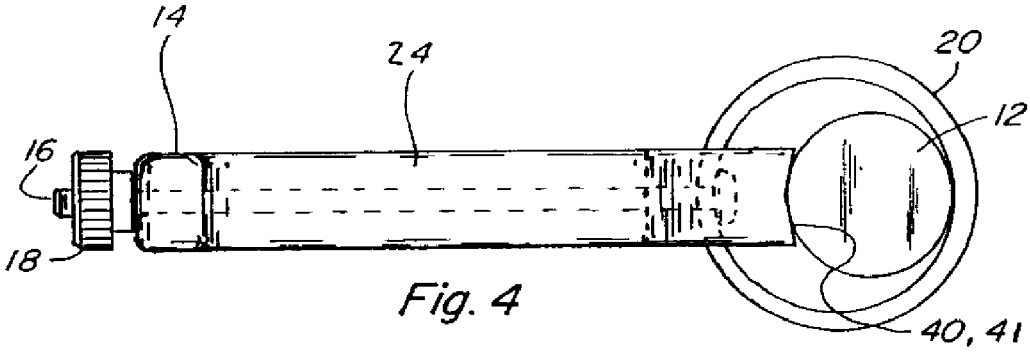
FIG. 4 is a top view of a firearm supporting apparatus.
Figure 5:
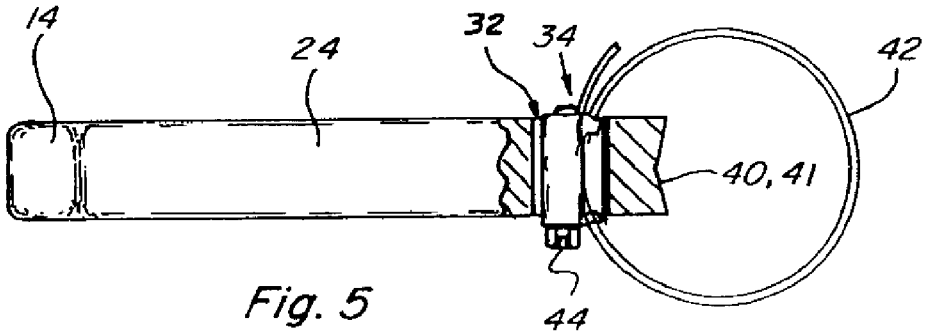
FIG. 5 is a top, partial cut-away, view of a firearm supporting apparatus according to an alternate embodiment.
Figure 6:
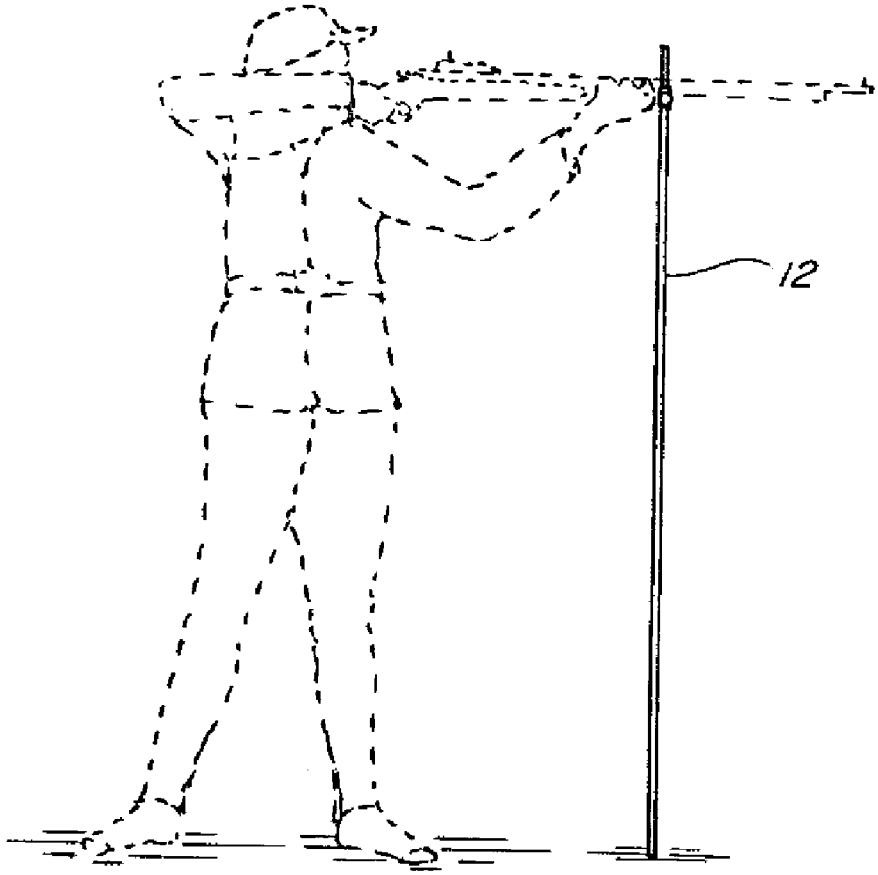
FIG. 6 is a schematic view of a firearm supporting apparatus in use by a shooter in a standing position.
Figure 7:
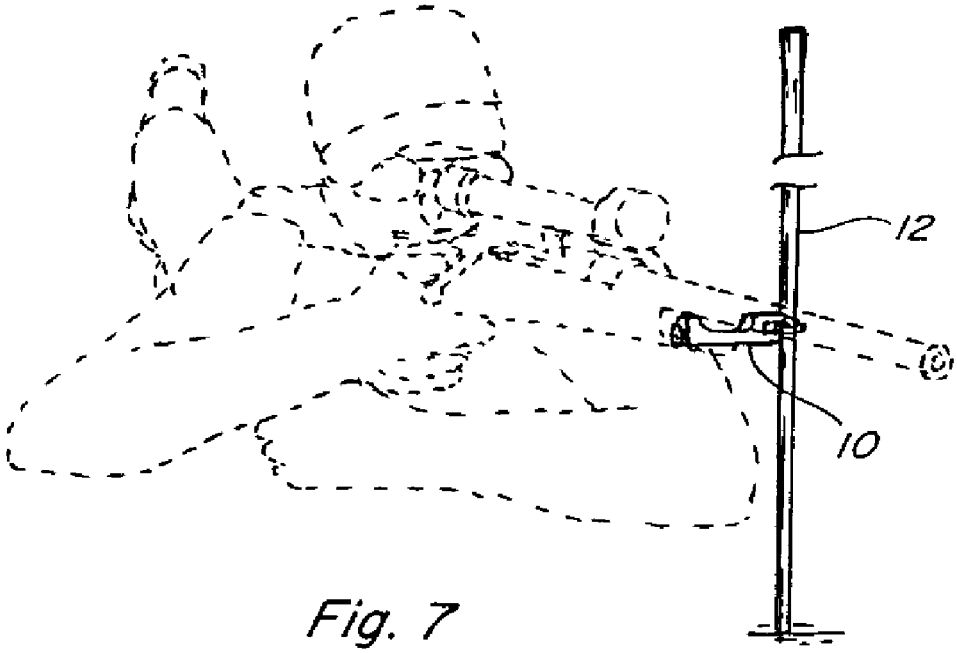
FIG. 7 is a schematic view of a firearm supporting apparatus in use by a shooter in a prone position.

FIGS. 1-7 illustrate a gun rest 10 supported by a shaft 12. The shaft 12 may be of any length. The diameter of the shaft 12 is limited only by the inside diameter of the collar 20 (discussed in more detail below). Advantageously, the shaft 12 may be a walking stick that the user already possesses or may be a tree limb of suitable length and thickness that is readily found in the field. Alternatives for the shaft 12, also include wood, metal, plastic or fiberglass poles, although a relatively narrow, elongated item made of any suitably rigid material will suffice. Due to the gun rest's ability to be utilized with shafts 12 of any length, almost any shooting position can be accommodated, including sitting, kneeling, and standing, regardless of the height or age of the user. FIGS. 1, 6 and 7 illustrate a gun rest 10 in use by a shooter in kneeling, standing and prone positions, respectively. While the shaft shown in these figures is truncated for space purposes, it should be noted that the very same shaft could be used in all three shooting positions, which presents a significant advantage for the gun rest 10.

The gun rest 10 is primarily composed of a support 14, a collar 20, a threaded member 16 and a fastening/adjustment device 18. The support 14 is provided with a longitudinal through hole 22 extending entirely through the length of the support 14. One end of the support 14 is provided with a rectangular collar slot 26. The collar slot 26 accommodates the collar 20 when the gun rest 10 is assembled. The collar slot 26 also separates upper 28 and lower 30 support arms. The support 14 may be constructed of practically any rigid material, including wood, plastic, metal, or composites. However, in a preferred embodiment, the support is constructed of a relatively lightweight material, such as wood, plastic or composite, to enhance its portability and ease of use.

In a preferred embodiment, the collar 20 itself is constructed of a relatively rigid material, such as PVC, plastic, metal, or other rigid materials. However, it is acceptable for the collar 20 to be made of more flexible materials, such as thinner plastic or metal bands, leather, or fabric. The collar 20 is provided with a hole 36 in one side. In a preferred embodiment, the height of the collar 20 on the side having the hole 36 is somewhat greater than the collar's height on the side opposite the hole 36. This variation in height, shown in FIG. 3, eases the task of inserting the threaded member 16 into the hole 36, as described below. In another embodiment, a plurality of collars 20 with varying diameters is provided. This allows the gun rest 10 to be used with an even larger number of shafts 12 of different diameters.

In a preferred embodiment, the threaded member 16 and collar 20 are a single piece, similar to an eyebolt. This arrangement advantageously results in a reduction of material costs and further strengthens the overall structure.

The gun rest is assembled by inserting the threaded member 16, threaded end first, through the collar hole 36 and then through the longitudinal through hole 22 in the support 14. The collar hole 36 should be large enough to allow the body of the threaded member 16, which may be a bolt, screw or other similar elongated threaded device, to freely pass yet small enough to prevent the head of the threaded member 16 from passing. The fastening/adjustment device 18, which may take the form of a wing nut, threaded knob, or a similar threaded object, is then screwed onto the threaded end of the threaded member 16 to secure the assembly.

Once the gun rest 10 is assembled it is ready to be secured to the shaft 12 at any point along the shaft's height. The fastening/adjustment device 18 should be unscrewed slightly to allow the collar 20 to be moved slightly away from the support, thereby exposing at least the majority of the inside diameter of the collar 20. This minimizes the interference of the upper 28 and lower 30 support arms with the shaft 12 as the collar 20 is slipped over the shaft 12. Once the collar 20 is slipped onto the shaft 12, a user may determine a desirable height for the gun rest 10 along any part of the length of the shaft 12. Once a desirable height is found, the user secures the gun rest at that height by screwing the fastening/adjusting device 18 further onto the bolt 16. This action draws the collar back into the collar slot 26, allowing the upper 28 and lower 30 support arms to overlap the edge of the collar 20 and eventually engage the shaft 12. As the fastening/adjusting device 18 is tightened, the shaft 12 is gradually engaged by the far side of the collar 20 on one side of the shaft 12 and by the upper 28 and lower 30 support arms on the opposite side of the shaft 12, effectively "pinching" the shaft between these points and thereby securing the gun rest 10 onto the shaft 12 at this position. In order to remove or adjust the gun rest 10, the user must simply loosen the fastening/adjusting device 18, thereby disengaging the collar 20 and upper 28 and lower 30 support arms from the shaft 12 slightly. The positioning of the hole in the collar 20, and consequently the connection with the threaded member 16, directly opposite that portion of the collar 20 that engages the shaft ensures a more rigid and stable connection with the shaft 12.

In an alternate embodiment, the ends of the upper 28 and lower 30 support arms are provided with concave clamping surfaces 40 in order to increase the actual contact area between the rounded side of the shaft 12 and the support arms, thereby providing a more secure clamping action between the support and the shaft. In addition, the clamping surfaces 40 may be provided with flexible pads 41, such as rubber, plastic, neoprene, leather, or the like, to minimize any marring of the shaft surface. This is particularly desirable if a user utilizes a favorite walking stick as the shaft 12.

In a preferred embodiment, the support 14 is provided with a contoured surface 38 forming a concave cradle to positively support a firearm or a user's hand. In a particularly preferred embodiment, at least the contoured surface 38 is covered with a flexible material 24, such as cloth, low density plastic, neoprene, rubber, or leather. This covering prevents the support 14 from scratching firearms and also reduces any noise made by the gun rest 10 if it is dropped, which is essential when hunting. In addition, if the flexible material 24 used is of a non-skid design, such as neoprene or rubber, for example, slippage of firearms during firing is minimized. This covering may be extended to cover the entire support 14. The support 14 and/or flexible material covering 24 may also be provided with a suitable coloring, i.e., camouflage print, to allow the gun rest 10 to better blend in with a user's other hunting gear and clothing.

FIG. 5 illustrates an alternate embodiment of the gun rest 10. The support 14 is provided with a transverse hole 32 instead of a collar cutout and longitudinal through hole. An adjustable clamp 34, e.g., a standard hose clamp with a flexible metal band 42 and threaded tightening mechanism 44, is installed in the transverse hole 32. Prior to installation of the gun rest 10 on the shaft 12, the adjustable clamp 34 is loosened to its largest diameter in order to allow the clamp 34 to fit over the shaft 12. Once the user has found a desirable height for the gun rest 10, the clamp 34 is tightened to secure the shaft 12 tightly between the flexible band 42 and a clamping surface 40, thereby fixing the gun rest 10 in position on the shaft 12. Similarly to the upper and lower support arms of the first embodiment, the clamping surface 40 may be concave. To remove or adjust the gun rest 10, the clamp 34 is simply loosened.

Figure 2:
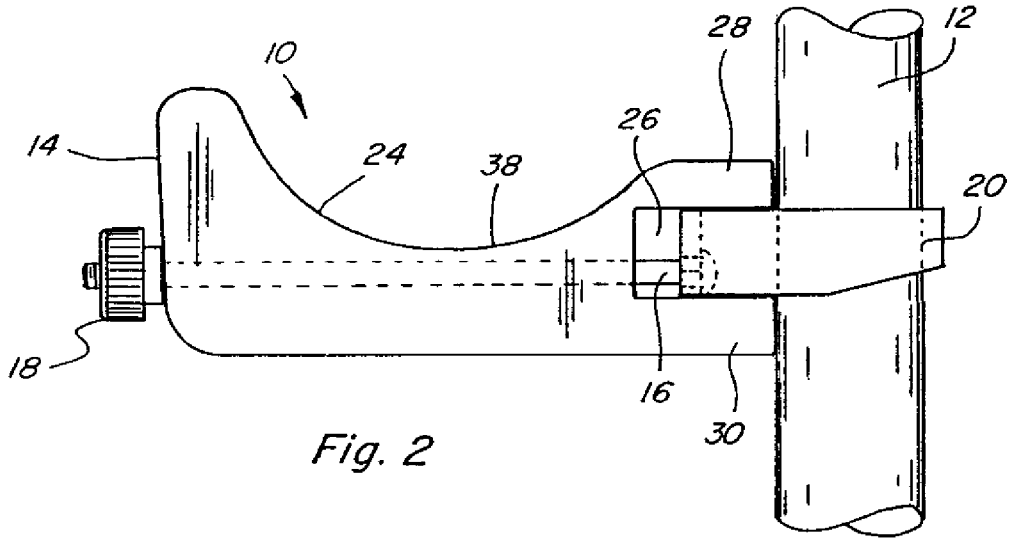
FIG. 2 is a side view of the firearm supporting apparatus of FIG. 1.
Figure 3:
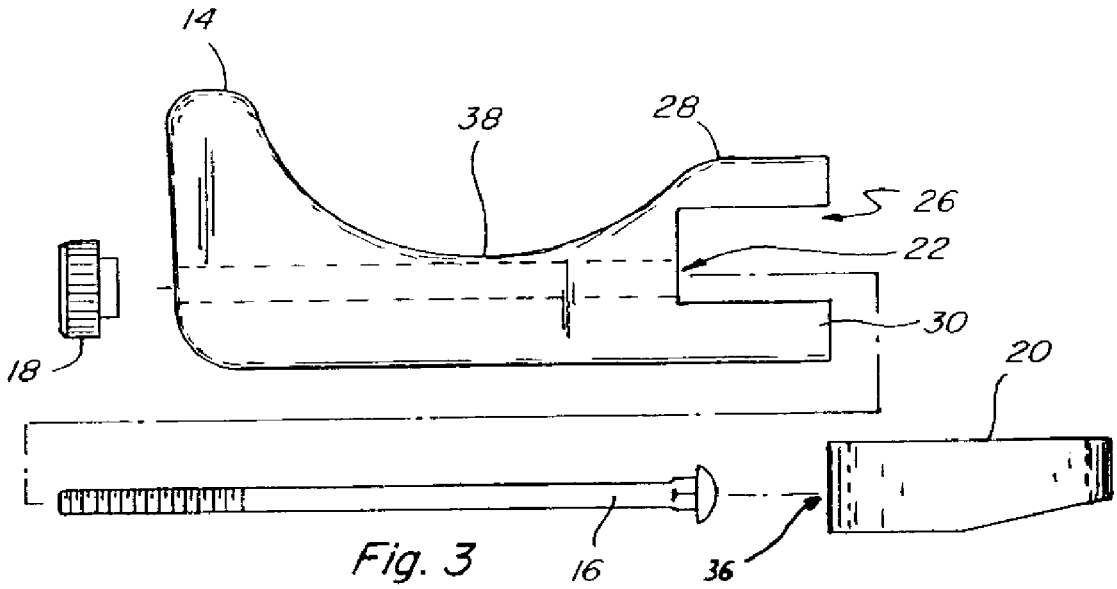
FIG. 3 is an exploded view of a firearm supporting apparatus according to another embodiment.
Figure 8:
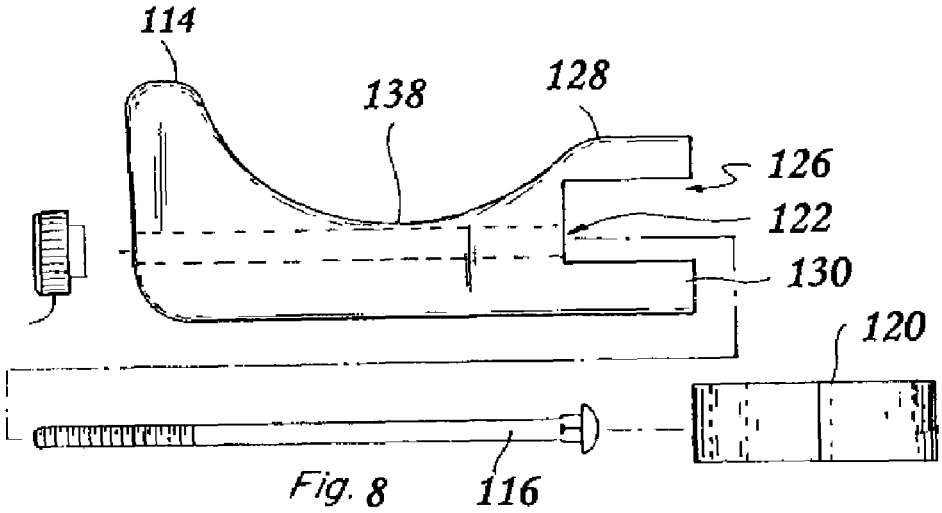
FIG. 8 is an exploded view of a firearm supporting apparatus according to yet another embodiment.
Figure 9:
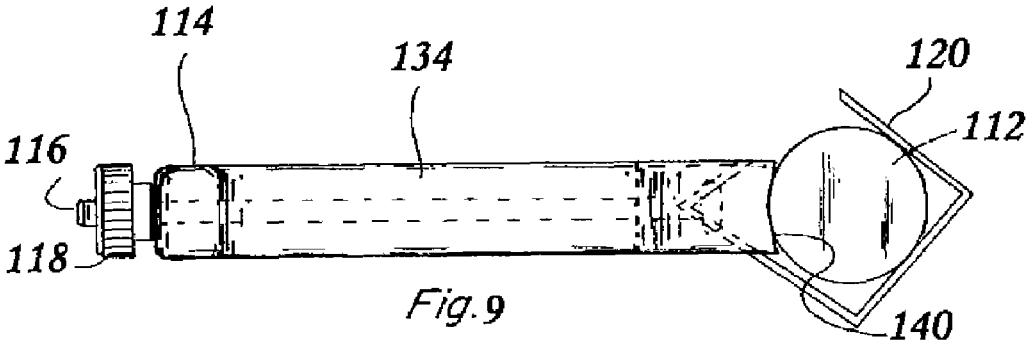
FIG. 9 is a top view of the assembled firearm supporting apparatus of FIG. 8.

FIGS. 8 and 9 illustrate an alternate embodiment of a firearm support 110 that is similar to the embodiment shown in FIGS. 2-4. As with that embodiment, firearm support 110 includes a support 114, a threaded member 116 and a fastening/adjustment device 118. However, the collar or attachment mechanism 120 of firearm support 110 is a rectangular or diamond-shaped structure with an open portion. In alternate embodiments, other basic shapes may be utilized for the attachment mechanism 120 with the common feature remaining the open portion in the structure. The threaded member 116 engages the attachment mechanism 120 at one corner, while the opposite corner of the attachment mechanism engages the surface of the shaft 112.

The opening in the attachment mechanism 120 enhances use of the firearm support 110 by allowing it to be engaged with a shaft 112 at any point along the length of the shaft 112 rather than being slipped over the very top or bottom of the shaft 112 and then moved along the length of the shaft 112 to a desired position. This feature also enables the support to be used with saplings or fence posts, e.g., between railings or wires. The angling of the attachment mechanism 120, with the corner of the mechanism directly opposite the connection with the threaded member 116 engaging the shaft 112, serves to evenly distribute the forces exerted on the mechanism 120 and provide a more rigid and stable connection to the shaft 112. While it is within the scope of the invention to construct the attachment mechanism out of a number of suitable materials, an alloy steel is used in a preferred embodiment to provide additional strength to minimize deflection of the attachment mechanism during use.

As with the other disclosed embodiments, it is within the scope of the invention to utilize a one piece threaded member 116/attachment mechanism 120 combination that is similar in appearance to an eyebolt. This arrangement provides additional rigidity and stability to the overall mechanism.

Figure 10:
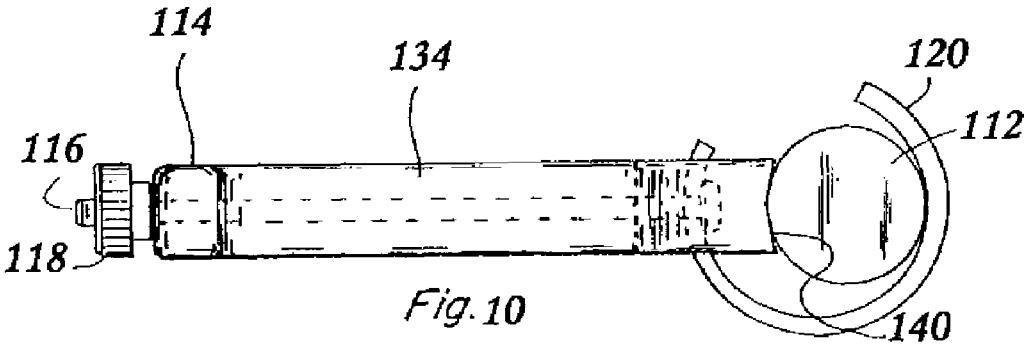
FIG. 10 is a top view of a variation of a firearm support similar to that of FIG. 8

The remaining structures and manner of assembly of the embodiment of FIGS. 8-10 are similar to those of the previously described embodiment.

Other objects, features and advantages of the present invention will be apparent to those skilled in the art. While preferred embodiments of the present invention have been illustrated and described, this has been by way of illustration and the invention should not be limited.

What is claimed is:

1. A firearm supporting apparatus suitable for use with shafts of varying diameters and lengths, including:

an elongated support member having an end surface and a top surface, wherein said end surface further comprises a clamping surface and said top surface further comprises a firearm supporting surface and said clamping surface and said firearm supporting surface are integral with the elongated support member;

a collar having a break formed therein, said collar connected with the elongated support member; and an adjustable mechanism connecting the collar with the elongated support member and adjusting the position of the collar relative to the clamping surface of the support member, resulting in movement of the collar relative to the clamping surface in a direction parallel to the elongated support member, the collar and clamping surface securing the support member to a shaft.

2. The firearm supporting apparatus as set forth in claim 1, wherein the adjustable mechanism includes an elongated threaded member connected with the collar and the elongated support member and a fastening device associated with the threaded member;

wherein said elongated threaded member is connected with said collar at a first point of said collar directly opposite a second point of said collar at which said collar engages said shaft; and wherein tightening and loosening the fastening device on the threaded member adjusts the position of the collar relative to the clamping surface.

3. The firearm supporting apparatus as set forth in claim 1, wherein the adjustable mechanism includes an elongated threaded member integrally formed with the collar and the elongated support member and a fastening device associated with the threaded member; and wherein tightening and loosening the fastening device on the threaded member adjusts the position of the attachement mechanisim relative to the clamping surface.

4. The firearm supporting apparatus as set forth in claim 1, wherein the collar comprises a partial diamond-shaped structure.

5. The firearm supporting apparatus as set forth in claim 1, wherein the collar comprises a partial circular structure.

6. The firearm supporting apparatus as set forth in claim 1, wherein the firearm supporting surface is contoured.

7. The firearm supporting apparatus as set forth in claim 6, wherein the firearm supporting surface is a concave cradle.

8. The firearm supporting apparatus as set forth in claim 2, wherein the clamping surface includes upper and lower support arms;

wherein the support member defines a slot separating said upper and lower support arms; and wherein a portion of said collar extends transversely through said slot.

9. The firearm supporting apparatus as set forth in claim 1, further including a flexible material covering a portion of the elongated support member.

10. The firearm supporting apparatus as set forth in claim 1, wherein at least the firearm supporting surface is covered by a flexible material.

11. The firearm supporting apparatus as set forth in claim 10, wherein the flexible material is provided with a non-skid surface.

12. The firearm supporting apparatus as set forth in claim 1, wherein the clamping surface is concave.

13. The firearm supporting apparatus as set forth in claim 1, wherein the clamping surface is covered by a flexible material.

* * * * *